US005455971A

United States Patent [19]

Sakakibara et al.

[11] Patent Number: 5,455,971

[45] Date of Patent: Oct. 10, 1995

[54] WATER-CLOSET BOWL AUTOMATIC FLUSHING SYSTEM

[75] Inventors: Shigeru Sakakibara; Shigeru Takagi, both of Tokoname, Japan

[73] Assignee: Inax Corporation, Tokoname, Japan

[21] Appl. No.: 74,357

[22] Filed: Jun. 10, 1993

Related U.S. Application Data

[63] Continuation of Ser. No. 799,190, Nov. 27, 1991, abandoned.

[30] Foreign Application Priority Data

Nov. 29, 1990 [JP] Japan ..... 2-334369
Nov. 29, 1990 [JP] Japan ..... 2-334370

[51] Int. Cl.[6] ..... E03D 1/00
[52] U.S. Cl. ..... 4/313; 4/DIG. 3
[58] Field of Search ..... 4/304, 313, DIG. 3; 251/129.04

[56] References Cited

U.S. PATENT DOCUMENTS 4,570,272 2/1986 Kawaguchi et al. ..... 4/302
5,187,816 2/1993 Chiou ..... 4/304 X
5,251,340 10/1993 Su-Land ..... 4/304
5,251,872 10/1993 Kodaira ..... 4/304 X

FOREIGN PATENT DOCUMENTS 3008025 9/1981 Germany ..... 4/313
3339896 5/1985 Germany ..... 4/313
63-44035 2/1988 Germany .
63-541 1/1988 Japan .
63-151734 6/1988 Japan .
63-151733 6/1988 Japan .
63-171931 7/1988 Japan .
1-121422 5/1989 Japan .
1-203534 8/1989 Japan .
1-203535 8/1989 Japan .
1-278627 11/1989 Japan .
1-299929 12/1989 Japan .
0299929 12/1989 Japan ..... 4/313
0212525 9/1991 Japan ..... 4/304

*Primary Examiner*—Charles E. Phillips
*Attorney, Agent, or Firm*—Sterne, Kessler, Goldstein & Fox

[57] ABSTRACT

An automatic toilet flushing system which detects when a user sits on the toilet for use and, instead of operating a flush handle for flushing, performs flushing in association with the user's action of standing up to leave the toilet. A forced flushing sensor is also provided so that water can be flowed for flushing through deliberate action of the user.

3 Claims, 5 Drawing Sheets

WATER-CLOSET BOWL AUTOMATIC FLUSHING SYSTEM

CROSS-REFERENCE TO RELATED APPLICATION

This application is a continuation of application Ser. No. 07/799,190 filed Nov. 27, 1991.

FIELD OF THE INVENTION

The present invention relates to an automatic toilet flushing system which detects when a user sits on a toilet seat and automatically flushes the toilet when the user stands up, rather than the user manually operating a flush handle.

Furthermore, a forced flushing sensor is provided in order to flow water for rinsing the toilet bowl through deliberate action of the user.

BACKGROUND OF THE INVENTION

A urinal (where a user only stands) automatic washing system is known in the art whereby, when a user stands before the urinal, an automatic circuit starts, and, when urination ends, it operates to flow water for washing the interior of the urinal.

SUMMARY OF THE INVENTION

The present invention aims at performing automatic flushing for a toilet. The automatic toilet flushing system of the present invention disposes a position detection sensor at the rear of the toilet, positioned so as to project light on the sitting user. When the user first sits on the toilet, preliminary flushing is carried out to first drench the interior of the toilet bowl with water. The preliminary flush makes it easier to wash out the interior of the toilet bowl by a full water flush automatically initiated when the sitting user exits the lavatory.

The automatic toilet flushing system of the present invention also includes a forced flushing sensor for user initiation of a full flush of the toilet bowl. The forced flushing sensor can be activated by a sitting or standing user, without contact with any mechanism such as a lever or handle. The forced flushing sensor is disposed near the position detection sensor at the rear of the toilet thereby enabling the electronic circuits to be located together.

DESCRIPTION OF THE PREFERRED EMBODIMENT

Figure 1:
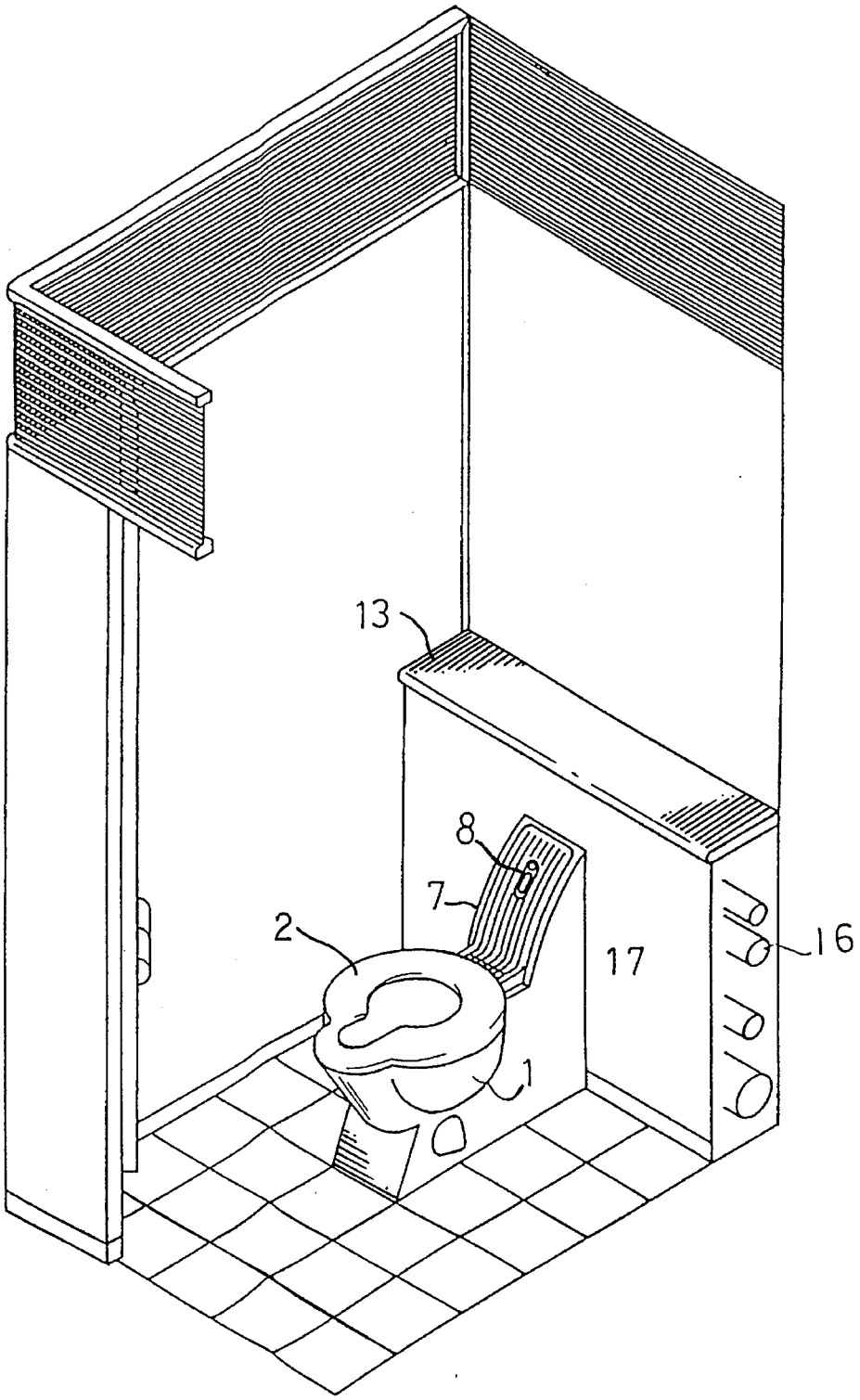
FIG. 1 is a perspective view of a toilet with the automatic toilet flushing system of the present invention.

Referring to FIG. 1, in a lavatory is disposed a pipe-line covering stand 13, in which water-flushing pipes 16 are housed. A toilet 1 is disposed at the center of the lavatory and a toilet seat 2 is mounted on the toilet 1. The toilet seat 2 is capable of being upwardly rotated to expose the toilet 1 when used by men for urination. At the center of a decorative cover 7 is disposed a sensor cover 8. Sensor cover 8 covers electronic box 15 (FIG. 5) which is disposed at the rear of toilet 1.

Figure 2:
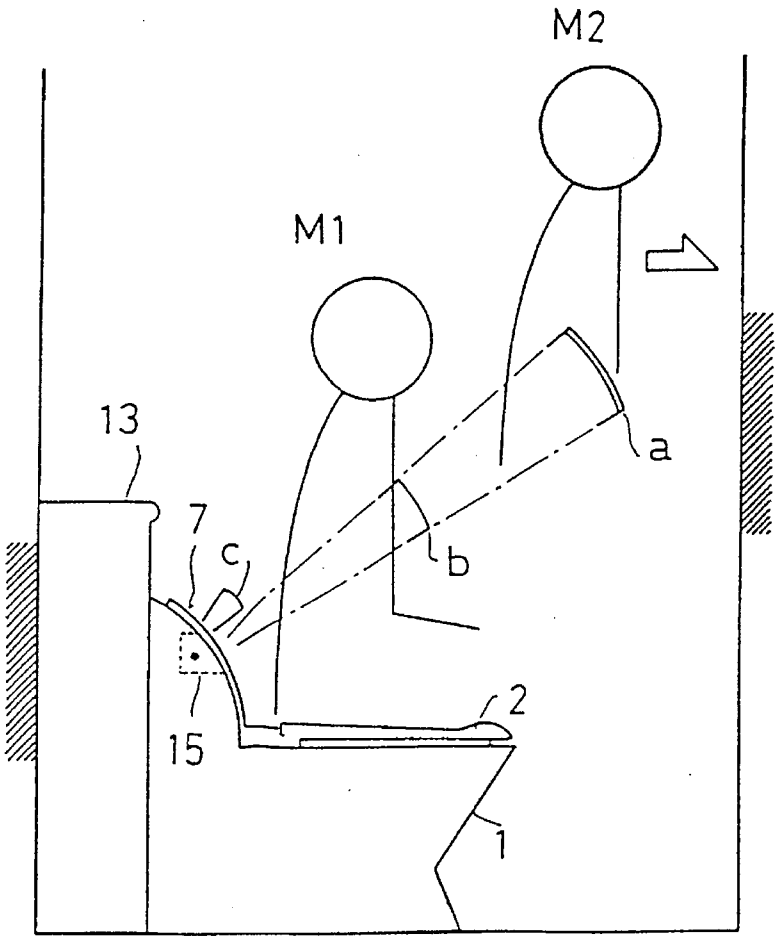
FIG. 2 is a side view of FIG. 1 showing a first position M1 where a user is sitting on the toilet, and a second position M2 where the user is standing up when finished using the toilet, both of which are detected by a position detection sensor.
Figure 5:
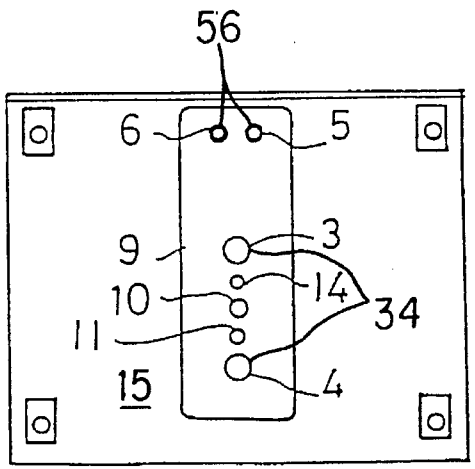
FIG. 5 is a plan view in part of the position detection sensor and the forced water-flush sensor of the present invention.
Figure 3:
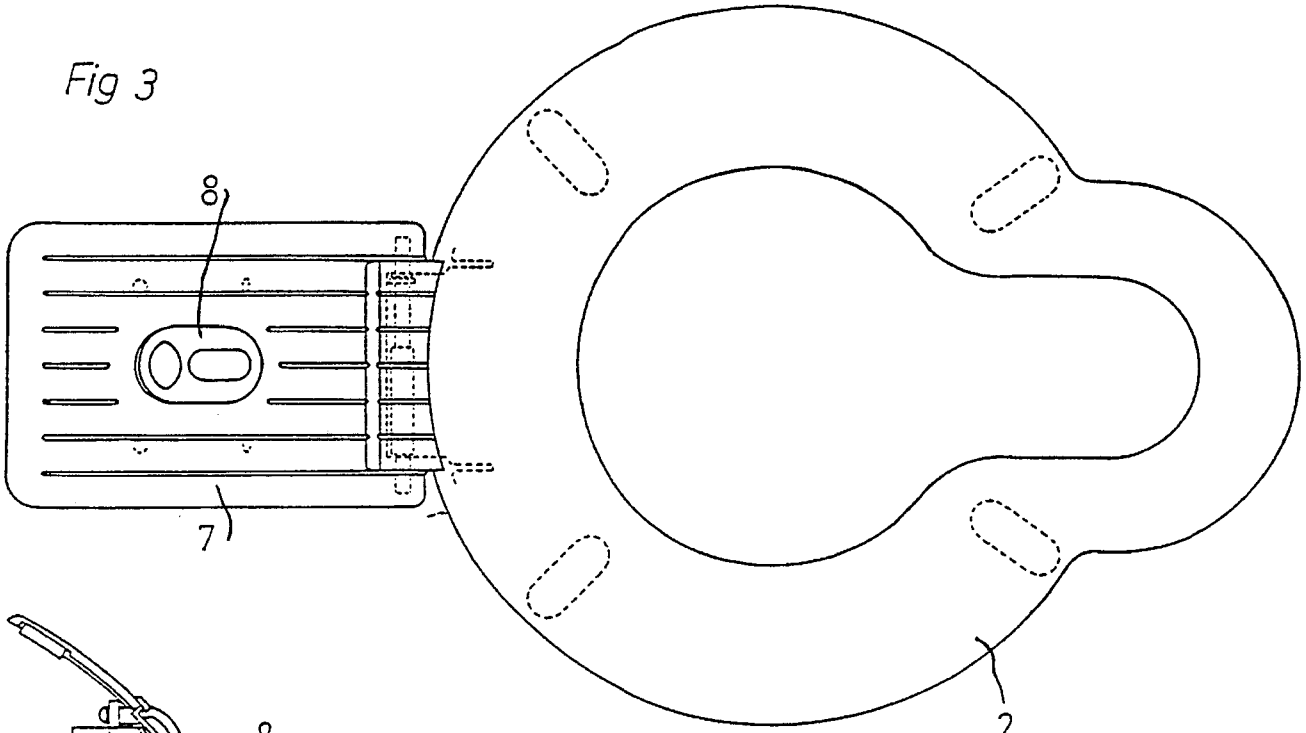
FIG. 3 is a plan view of a toilet provided with the automatic toilet flushing system of the present invention.

The electronics for the automatic toilet flushing system of the present invention are contained in electronic box 15 mounted between the toilet 1 and pipe-line covering stand 13 at the rear of the toilet 1 (see FIG. 2). On the upper surface of the electronic box 15, as shown in FIG. 5, is provided a sensor mounting plate 9. At the upper edge of the sensor mounting plate 9 are disposed, in side-by-side relation, a forced water-flush sensor projector 5 and a forced water-flush sensor photodetector 6. Projector 5 and photodetector 6 together constitute the forced water-flush sensor 56. Also disposed on sensor mounting plate 9 are position detection sensor photodetector 3 and a position detection sensor projector 4. Photodetector 3 and projector 4 together constitute the position detection sensor 34.

Between the position detection sensor photodetector 3 and the position detection sensor projector 4 on sensor mounting plate 9 are disposed a human body detection display lamp 14, a remote control photodetector 10, and a remote control stop display lamp 11.

In order to prevent automatic flushing while the toilet is being cleaned, the automatic toilet flushing system of the present invention can be deactivated. The remote control photodetector 10, separately operated by a remote control operation device 20 (FIG. 6), stops the automatic toilet flushing system from flowing water in vain each time a cleaner approaches the toilet 1 for cleaning the lavatory. When an infrared ray is emitted from the remote control operation device 20 (FIG. 6) and is received by the remote control photodetector 10, a circuit of the automatic toilet flushing system is shut off, causing the remote control stop display lamp 11 to illuminate, indicating that the automatic toilet flushing system is deactivated. After cleaning, when the infrared ray is again emitted by the remote control operation device 20, the automatic toilet flushing system is reset and the remote control display lamp 11 is turned off, thereby re-starting the automatic flushing system.

The automatic toilet flushing system also includes a forced flushing sensor 56 for rinsing the toilet bowl upon deliberate action by the user. When an infrared ray projected from the forced flushing sensor projector 5 is reflected by the hand of the user, the forced flushing sensor photodetector 6 detects the reflection of the infrared ray and turns on the forced flushing sensor 56, thereby forcibly flowing water for rinsing the toilet bowl. The distance c to which forced flushing sensor projector 5 projects and within which forced flushing sensor photodetector 6 detects, as shown in FIG. 2, is small. Elongate slot or opening at the center of toilet seat 2 is aligned with forced flushing sensor 56 so that when toilet seat 2 occupies an upwardly rotated, non-use position, forced flushing sensor 56 remains exposed through the elongate slot. Thus, when a male user lifts the toilet seat 2 to stand and urinate, the forced flushing sensor is not activated by toilet seat 2. Once urination is complete, the male user may deliberately intercept the infrared ray from projector 5 with his hand within the forced flushing sensor length c to cause water to flow into the toilet 1.

The automatic toilet flushing system uses a position detection sensor 34 to detect the presence of a sitting user in order to automatically perform the preliminary and full water flushes. The sensor length of the infrared ray from the position detection sensor 34, as shown in FIG. 2, is designed to be switched between two sensor lengths, an in-use state sensor length b, and an end state sensor length a. When the lavatory is empty, in other words, at the time when the former user leaves but prior to the next user arriving, the position detection sensor 34 has been automatically switched to be in the in-use state sensor length b. When the user enters into the lavatory and sits on the toilet seat 2, a person is within the in-use state sensor length b, whereby the automatic toilet flushing system starts its operation. Simultaneously, the position detection sensor 34 is switched to the end state sensor length a. When the user then leaves the end state sensor length a, the finish switch of the automatic toilet flushing system is turned on causing water to flow into the toilet 1 for full flushing.

The position detection sensor 34 is switched into the end-state sensor length a and in-use state sensor length b by changing the sensitivity of the position detection sensor, since two separate sensors are not provided. The sensitivity of the position detection sensor 34 is changed based upon the level of intensity of the light (projected from the position detection sensor projector 4, reflected from a human being, and detected by position detection sensor photodetector 3) in each of the two sensor length regions. That is, the sensitivity is dull for the in-use state sensor length b, so that a high level of intensity of reflected light is required for detection. Sensitivity is sharp for the end state sensor length a, so that only a low level of intensity of reflected light will trigger detection.

Figure 6:
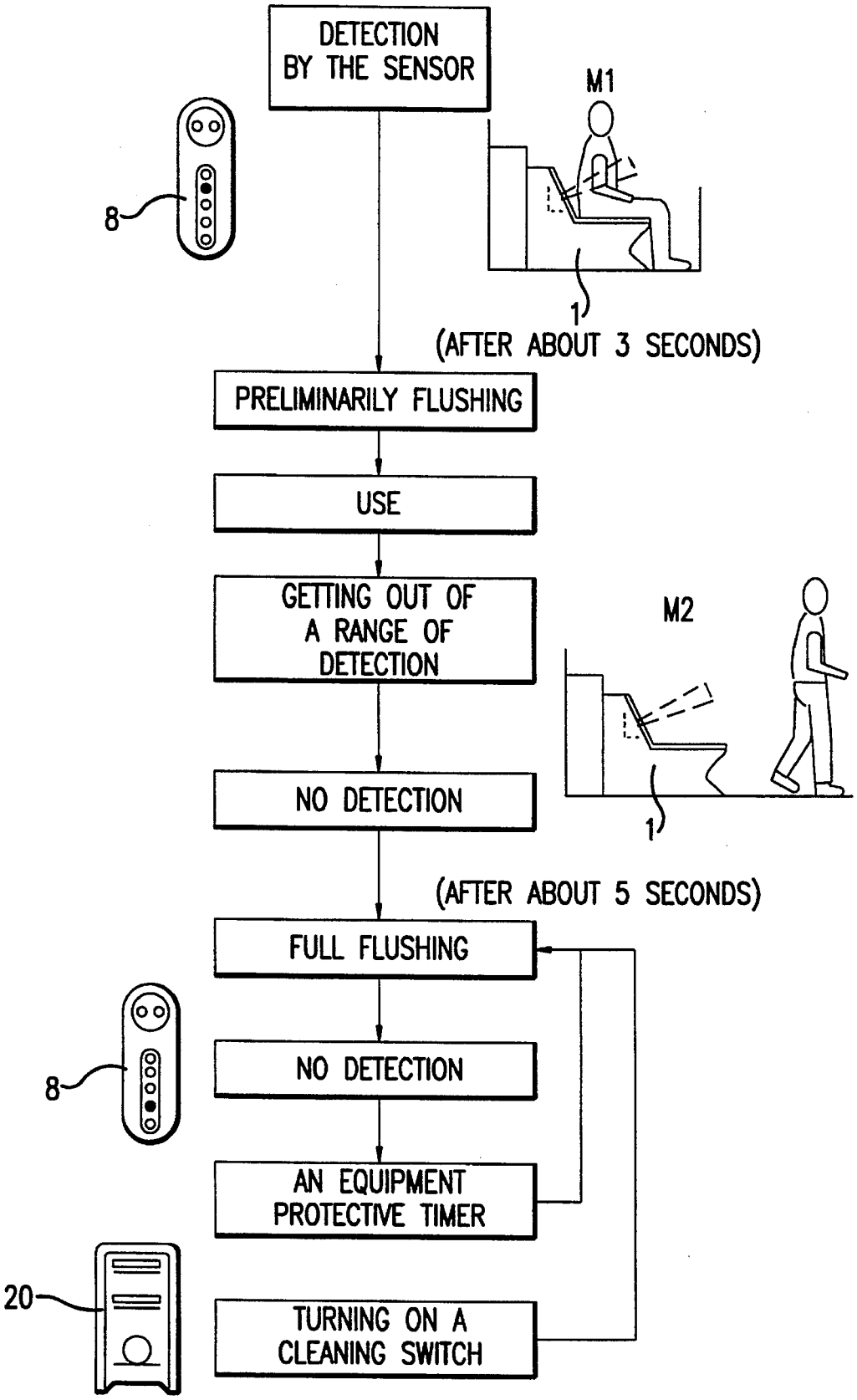
FIG. 6 is a control block diagram of the automatic toilet flushing system of the present invention.
Figure 7:
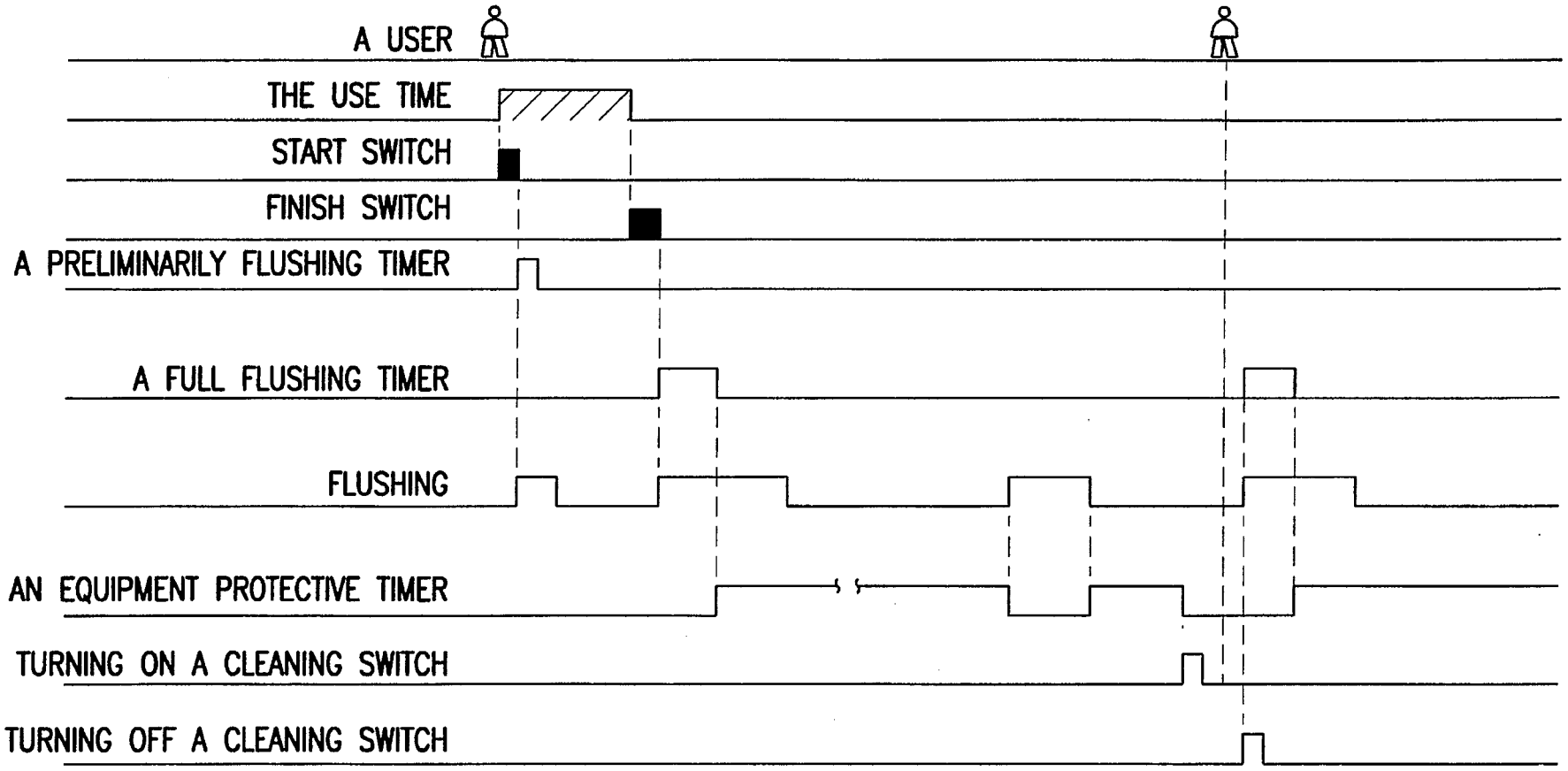
FIG. 7 is a time chart of the same.

Next, explanation will be given on operation of the present invention in accordance with FIGS. 6 and 7. FIG. 6 is a block diagram of the automatic toilet flushing system of the present invention with a sitting user, and FIG. 7 is a time chart thereof.

A user enters the lavatory, at which time the position detection sensor 34 has previously been switched to be of the in-use state sensor length b, the length b being about 450 mm. The position detection sensor 34 detects when the user enters into a first position M1 and sits on the toilet seat 2 so as to turn on the start switch 151 contained in electronic box 15 (see FIG. 4). After about three seconds (t1), the preliminary flushing timer is turned on, thereby preliminarily flowing water for washing the toilet 1. When the user enters into the in-use state sensor length b and the start switch is turned on, the position detection sensor 34 is switched to the end state sensor length a.

Figure 4:
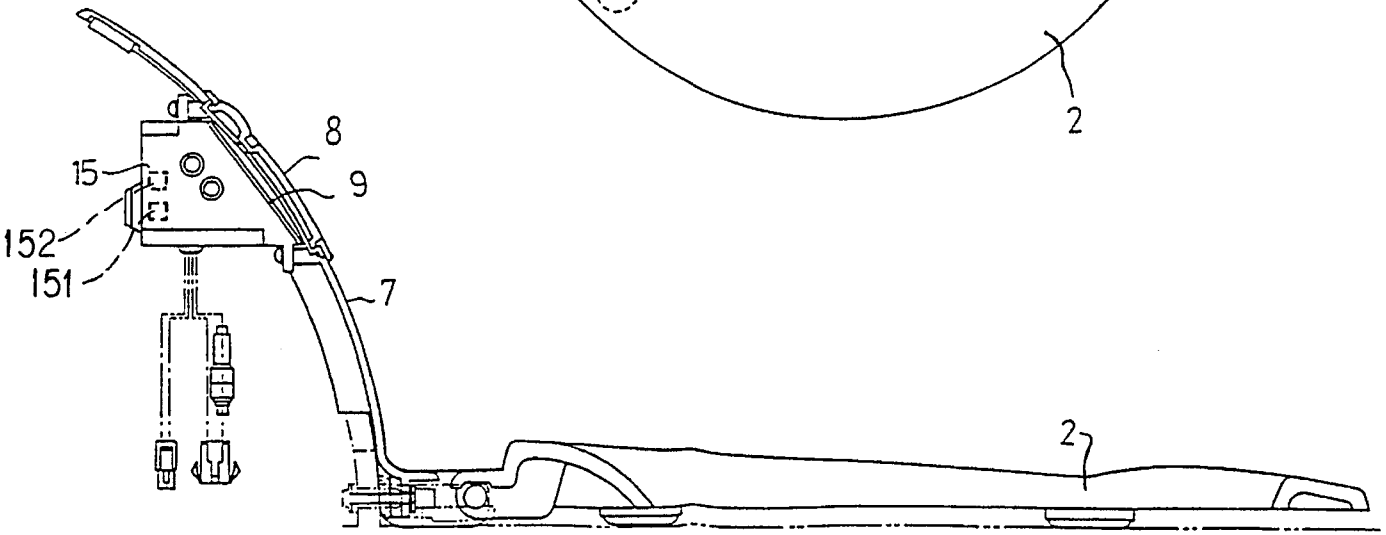
FIG. 4 is a side view thereof.

Next, when the user finishes and stands up so as to exit the lavatory (second position M2), and is outside the range of end state sensor length a (which is about 950 mm), the position detection sensor 34 turns on the finish switch 152 contained in electronic box 15 (see FIG. 4). When the finish switch is on for about five seconds (t2), the full flushing timer is turned on. Then, more water than the preliminary flushing is flowed into the toilet to perform the full flushing.

As described above for the user initiation of a full flush, a separate forced flushing sensor 56 is provided so that the user can intercept its infrared ray with his hands, and turn on the forced flushing sensor 56 to perform a forced flushing.

A separate equipment protective timer is also provided. When the full flushing is not carried out for 24 hours or more, flushing is carried out once every 24 hours in order to protect the automatic toilet flushing system. The equipment protective timer starts the time counting from the time of finishing the last full flushing. However, when the remote control operation device 20 deactivates the automatic toilet flushing system, the time counting is interrupted. As shown in FIG. 7, the equipment protective timer does not continue to count during the cleaning state (time between Turning On a Cleaning Switch and Turning Off a Cleaning Switch). After cleaning, a cleaner operates the remote control operation device 20 to turn off a cleaning switch to re-start the automatic flushing system by turning on the full flushing timer and initiating flushing (see FIG. 7). As shown in FIG. 7, the equipment protective timer is re-started when the full flushing timer turns off.

The present invention constructed as described above has the following effect. For a sitting user, the infrared ray from position detection sensor 34 is projected from the rear of the toilet onto the user. Since the infrared ray is projected from the side of the user facing the toilet (normally the user's back as shown in FIG. 2), the infrared ray can be reflected more reliably than if the ray was projected from a projector located on the side of the user facing away from the toilet.

The first position M1, where the start switch is on, is shifted or physically separated from the second position M2 where the finish switch is on to prevent the two switches from being activated simultaneously or in the reverse order (finish switch activated before start switch). If both positions M1 and M2 are coincident with each other, then the presence of the user at the position of M1 and M2 could activate both switches at the same time, or the finish switch could be activated before the start switch.

Since the preliminary flushing is performed when the user first sits on the toilet 1, the toilet is first drenched, thereby ensuring the full washing of the bowl after use. When the user sits in the first position M1, the time to start the preliminary flushing is quickened (t1>t2) so that the preliminary flushing can finish prior to use, and, when the user stands up to adjust his clothes, full flushing will occur automatically.

The forced flushing sensor 56 operates by intercepting the infrared ray with the user's hands, so that the user can carry out water flushing the same as the full flushing at any time. The forced flushing sensor 56 is part of the decorative cover 7 at the rear of the toilet and disposed in proximity to the position detection sensor 34, whereby all electronic circuit parts are located together. Also, since the forced flushing sensor 56 is actuated only within distance c, it will not be actuated when the user merely inadvertently moves his hands elsewhere.

What is claimed is:

1. An automatic toilet flushing system for use with a toilet, comprising:

a position detection sensor disposed at a rear of said toilet which operates at two sensor lengths;

a start switch disposed at the rear of said toilet, wherein said start switch is turned on to perform preliminary flushing of said toilet when a user of said toilet is within a first position detection sensor length in relation to said toilet, wherein said position detection sensor is switched from one of said two sensor lengths to another of said two sensor lengths when said start switch is turned on; and a finish switch disposed at the rear of said toilet, wherein said finish switch is turned on to perform full flushing of said toilet when the user of said toilet is outside of a second position detection sensor length in relation to said toilet.

2. An automatic toilet flushing system as set forth in claim 1, further comprising means for preliminary flushing said toilet when said start switch is turned on.

3. An automatic toilet flushing system as set forth in claim 2, further comprising means for full flushing said toilet; wherein said means for preliminary flushing said toilet starts preliminary flushing after a first time period measured from when said start switch is turned on, and wherein said means for full flushing said toilet starts after a second time period measured from when said finish switch is turned on, said second time period being longer than said first time period.

* * * * *